US005291625A

United States Patent [19]

Leslie

[11] Patent Number: 5,291,625

[45] Date of Patent: Mar. 8, 1994

[54] BODY SUPPORT PADS AND MATTRESSES

[76] Inventor: Philip L. Leslie, 5340 Calvin Ave., Tarzana, Calif. 91356

[21] Appl. No.: 100,386

[22] Filed: Aug. 2, 1993

[51] Int. Cl.[5] ..... A47G 9/06

[52] U.S. Cl. ..... 5/420; 5/455

[58] Field of Search ..... 5/417–420, 5/455, 502, 413

[56] References Cited

U.S. PATENT DOCUMENTS

| | | | |
|---|---|---|---|
| 1,347,642 | 7/1920 | McNatt | 5/502 |
| 3,137,871 | 6/1964 | Florio | 5/502 X |
| 3,199,123 | 8/1965 | Komiske | 5/502 |
| 3,336,610 | 8/1967 | Geddings | 5/420 |
| 4,450,193 | 5/1984 | Staebler | 5/420 X |
| 4,549,323 | 10/1985 | Brockhaus | 5/455 |
| 4,601,076 | 7/1986 | Knobeloch | 5/420 X |
| 4,658,452 | 4/1987 | Brockhaus | 5/420 |
| 5,003,135 | 7/1991 | Creek | 5/413 |
| 5,161,271 | 11/1992 | Gronbach | 5/422 X |
| 5,162,007 | 11/1992 | Leslie | 5/455 X |
| 5,203,041 | 4/1993 | Alonso | 5/420 |

*Primary Examiner*—Michael Trettel
*Attorney, Agent, or Firm*—Philip D. Junkins

[57] ABSTRACT

A mattress-like pad for human body support, comfort and recreational use in outdoor camping, in recreational vehicles, and in water craft. The pad, of rugged construction, includes a light-weight inner pad structure fabricated of a stacked arrangement of a multiplicity of like rectangularly configured layers of two-ply laminated sheet plastic material encapsulating between the plys of each layer a multiplicity of uniformly arranged, separated and sealed air bubbles. The air-bubble layers are maintained in their stacked arrangment by interlayer fasteners located proximate only the corners of the stack so as to permit some shifting of the layers to accommodate human body support characteristics and permit tight rolling-up of the mattress-like pad for storage and carrying thereof. The inner pad structure is removably encased within a bag-like containment cover fabricated of polyvinylchloride-coated polyester woven open mesh fabric material. The head end of the cover includes an extending closure flap with fasteners whereby when the matress-like pad is rolled up upon itself from the foot end to the head end of the cover and over the closure flap, the fasteners of the flap interact with mating fasteners affixed to the underside of the cover to maintain the mattress-like pad in its rolled-up configuration.

10 Claims, 1 Drawing Sheet

BODY SUPPORT PADS AND MATTRESSES

BACKGROUND OF THE INVENTION

1. Field of the Invention

The present invention relates to body support pads and mattresses. More particularly, the invention relates to light-weight pads and mattresses-like items for body support, comfort and recreational pleasure on dry land, in land vehicles, and in water craft.

2. Description of the Prior Art

Over recent years there has been proposed, manufactured and marketed a multiplicity of pads and mattress items for out-of-water body and body part support and comfort in both sitting and prone body positions. These items have included home use and medically prescribed sleeping pads and mattresses formed with internal cushioning springs, sponge rubber materials, and compressible foam plastic materials or formed so as to require water or air inflation. They have also included light-weight sleeping pads and mattresses for: hiking and camping; use in recreational vehicles; and use in water craft where such items are formed-up by air inflation.

The prior art inflatable pads and mattresses, of the type described above, are satisfactory from the standpoints of storage compactness, light tote weight and body support functionality, however, are subject to deflation if punctured. Further, body pads and mattresses of the type fabricated of light-weight, compressible sponge rubber or foam plastic materials are rather expensive, are difficult to store, and the materials of construction are subject to degradation when exposed to camping and boating environments.

It is a principal object of the present invention to provide improved sleeping pads and mattresses of light-weight rugged construction which afford body support and comfort by air buoyancy and which are not subject to sudden deflation by loss of air.

It is another object of the invention to provide improved light-weight pads and mattresses which provide body and body part support and comfort in both sitting and prone body positions and which can be rolled to a compact carrying or tote size.

It is yet another object of the present invention to provide improved sleeping pads and mattresses of light-weight rugged construction which provide body and body part support and comfort by air buoyancy, which can be rolled into compact tote configuration, and which are not subject to sudden deflation by loss of air.

These and other objects and advantages of the present invention will become apparent from the following summary of the invention and detailed description thereof taken in conjunction with the accompanying drawing figures.

SUMMARY OF THE INVENTION

The present invention relates to rectangular light-weight pads and mattresses which provide body and body part support and comfort by air buoyancy. The pads can be rolled into compact tote or carrying size and configuration and, although relying for their body support and comfort characteristics on air buoyancy, they are not subject to sudden deflation by loss of air. The pad and mattress articles of the invention all utilize in their construction an inner structure of multiple stacked layers of air-bubble sheet plastic material encased in a removable outer containment cover or bag of polyvinylchloride-coated polyester woven open mesh fabric material.

The air-bubble sheet plastic material is of known structure with uniformly situated, individually sealed air bubbles formed between two thin sheets of plastic material, such as sheet polyethylene. The air bubbles of typical air-bubble sheet material range in size (diameter) from about 3/16 of an inch to 1 inch and have a height dimension from the base flat sheet of about 1/16 of an inch to about ¼ of an inch. The rectangular stacked layers of air-bubble sheet plastic material, forming the inner structure of the pad and mattress articles of the invention, are maintained in their stacked relationship by corner grommets. Preferably, five layers of the air-bubble material (each layer being of ⅛ of an inch thick and providing over 400 separate air compartments per square foot) are used to form the inner structure of the pad or mattress. Thus, the inner structure of stacked layers of air-bubble sheet plastic material has a thickness of ⅝ inch or more. Each layer of the rectangular air-bubble material preferably measures 20 to 30 inches or more in width and 48 to 72 inches or more in length.

The outer cover or bag for the inner structure of stacked layers of air-bubble sheet material is fabricated from an elongated strip of the coated open mesh woven polyester fabric material. A first end portion of the strip of mesh material is folded back over a central (underside) portion of the material to the extent that such strip portions, when sealed along their mating edges, form a pad cover or bag having width and length dimensions adequate for containing the inner structure of the pad or mattress. Sealing of the mating edges of the mesh material may be accomplished by any one of a number of known means including heat sealing, radio frequency (RF) sealing, ultrasound sealing, etc. After the mating edges of the cover- or bag-forming material have been sealed together the containment cover or bag is turned in-side-out so that the sealed edges are contained within the cover or bag.

A second end portion of the strip of mesh material comprises a closure flap for the pad or mattress of the invention and extends beyond the open end of the containment cover or bag. The closure flap has affixed thereto several "Velcro" TM brand hook and loop fastener straps which are aligned with mating "Velcro" strips affixed to the central or underside portion of the cover or bag so that when the pad or mattress of the invention is rolled up for storage or carrying the hook and eye fasteners of the "Velcro" straps and strips meet and interact to maintain the pad or mattress in its rolled-up configuration. Mating "Velcro" strips are also provided at the open end of the cover or bag so that the inner pad structure of stacked layers of air-bubble material is maintained within the cover.

A typical pad or mattress in accordance with the invention weighs between about 2 and ½ pounds and about 5 and ½ pounds depending upon the width and length of the pad. The pad, although of light-weight construction, is tough and rugged for outside camping use. The coating for the outer containment cover or bag includes an ultra violet light inhibitor to protect the pad from sun exposure and the structure is mildew-proof. With five layers of air-bubble material forming the inner pad structure, each square foot of the pad contains over 2,000 separate air compartments so that accidental cuts or other perforations of the outer containment cover and inner pad structure will not result in deflation of the pad. As a further feature of the pad or mattress, the outer cover may be machine washed and the inner pad structure may be cleaned by hand washing or hosing.

BRIEF DESCRIPTION OF THE DRAWING FIGURES

DETAILED DESCRIPTION OF A PREFERRED EMBODIMENT OF THE INVENTION

Figure 1:
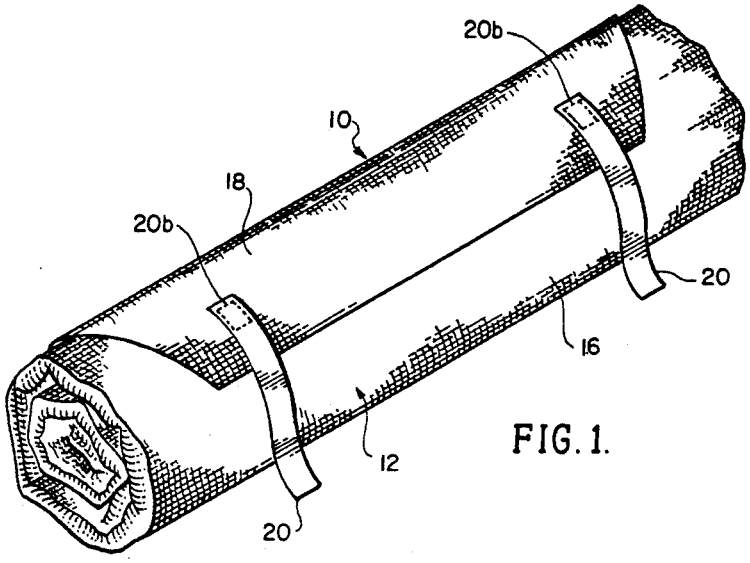
FIG. 1 is a perspective view of the light-weight body support pad or mattress in accordance with the present invention in its compact rolled configuration.
Figure 2:
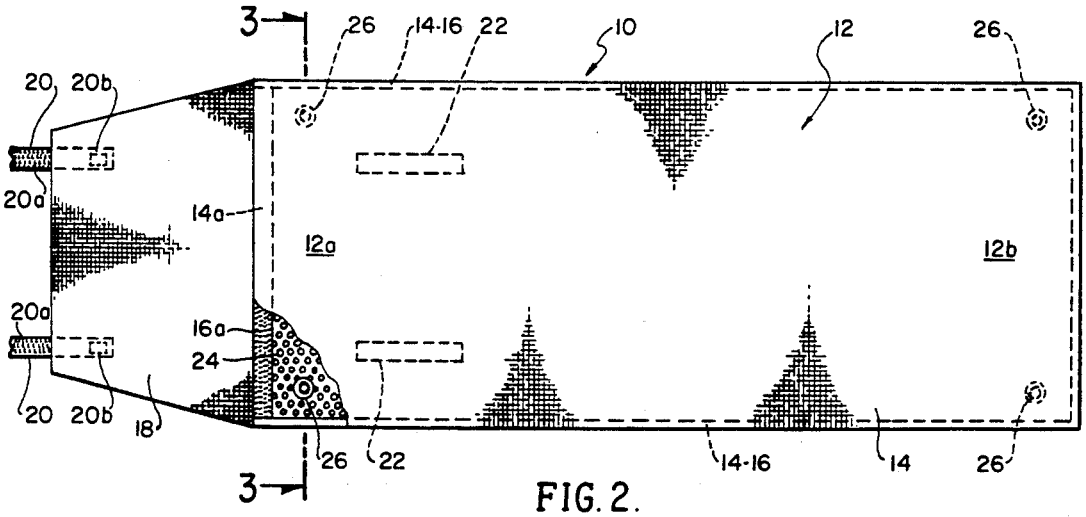
FIG. 2 is a top plan view of the body support pad or mattress of the invention in its unrolled state with its closure end flap extended.
Figure 3:
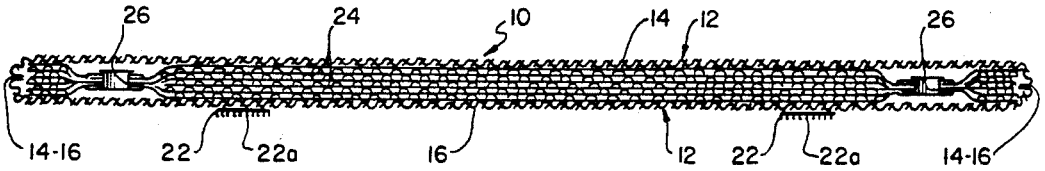
FIG. 3 is a sectional view of the body support pad or mattress of FIG. 2 taken along line 3—3 of such figure.

Referring now to the drawing figures, FIG. 1 is a perspective view of a home, camping, recreational vehicle or water craft body support pad or mattress 10 in accordance with the present invention in its compact rolled configuration. The pad or mattress includes a removable outer cover or bag 12 fabricated from a strip of polyvinylchloride-coated polyester woven open mesh fabric material. As shown in FIGS. 2 and 3, cover or bag 12 comprises a first end portion 14 of the strip of mesh material which is folded back over a central (underside) portion 16 of the material to the extent that such portions, when sealed along their mating edges, form the cover or bag. A second end portion 18 of the strip of mesh material comprises a closure flap for the pad or mattress. After the mating edges of the cover- or bag-forming mesh fabric material have been sealed together by known means, the cover or bag is turned in-side-out so the sealed edges 14–16 are contained within the cover or bag as shown in FIGS. 2 and 3. The resulting containment cover 12 for the pad or mattress 10 has a head end 12*a* which provides access to the cover and a foot end 12*b* which is closed by the fold of the strip of mesh material between the first end portion 14 and central portion 16 of the mesh material.

The inner removable structure of the pad or mattress is comprised of a stack of rectangular layers 24 of air-bubble sheet plastic material, each layer comprised of uniformly situated, individually sealed air bubbles formed between two thin sheets of plastic material in known fashion. As previously mentioned, air-bubble sheet materials are commonly provided in thicknesses ranging between 1/16 and ¼ of an inch. The stacked layers of the air-bubble sheet material are maintained in their stacked relationship by corner grommets 26 as shown in FIGS. 2 and 3. Preferably, five layers of the air-bubble material (⅛ of an inch thick with over 400 uniformly situated bubbles per square foot) are used to form the inner structure of the pad or mattress. Thus, the inner structure of the pad or mattress is approximately ⅝ inch thick and includes over 2,000 separate body-cushioning air-bubbles per square foot. Also as previously mentioned, the layers of air-bubble sheet material may measure 20 to 30 or more inches in width and 48 to 72 or more inches in length.

The second end portion of the strip of mesh material forming the outer pad containment cover or bag 12 comprises a closure flap 18 which extends beyond the open end of the cover or bag proximate the end 12*a* thereof. The closure flap 18 has affixed thereto several "Velcro" straps 20 (with appropriate fastening hooks or eyes 20*a*) which are aligned with mating "Velcro" strips 22 (with appropriate fastening eyes or hooks 22*a*) affixed to the outer surface of the central or underside portion 16 of the cover or bag 12. Thus, when the pad or mattress of the invention is rolled up for storage or carrying the hook or eye fasteners 20*a* of the "Velcro" straps 20 and the eye or hook fasteners 22*a* of the "Velcro" strips 22 meet and interact to maintained the pad or mattress in its rolled-up configuration such as is shown in FIG. 1. The straps 20 are affixed to the closure flap 18 by stitching 20*b* or by adhesive means. In like fashion, the mating strips 22 are affixed to the underside portion 16 of the cover or bag 12 by stitching or adhesive means.

Mating "Velcro" strips 14*a* and 16*a* are also provided at the open end of the containment cover or bag 12 so that the inner pad structure of stacked layers of air-bubble sheet material is maintained within the cover or bag. Thus, the inner pad structure of layers of air-bubble sheet material may be removed for cleaning by hand washing or hosing and the outer cover 12, with the inner pad structure removed, may be machine washed.

Because the stacked rectangular layers 24 of air-bubble sheet material are only affixed to each other by grommet fasteners 26 in the corner areas of the inner structure of the pad or mattress 10 of the invention, such layers are (throughout most of their interfacing surface areas) free to move with respect to one-another. This feature of the pad or mattress yields an overall structure that is easy to shape relative to any surface configuration for sitting or prone body support and comfort, a feature and characteristic which is not present with body support pads which are formed with an inner structure of rubber or compressible foam plastic materials. Further, this feature of the pad or mattress structure of the present invention permits the pad or mattress to be rolled into a tight roll for storage or carrying purposes.

The weight of the present pad or mattress is significantly less than the weight of body support pads with inner body support structures of rubber or foam plastic materials since pads in accordance with the invention include inner body support structures that are principally comprised of air pockets or bubbles. The pads of the invention are not subject to deflation upon puncture of several or even a considerable number of the air bubbles as are typical filled mattresses and the present pads do not require inflation and deflation prior to and after use.

A typical camping type small sleeping pad for a child, in accordance with the invention, would measure 20 inches in width and 48 inches in length and weigh 2 pounds and 5 ounces. A camping type sleeping pad for an adult would measure 24 inches in width and 72 inches in length and weigh about 4 pounds.

The invention described above is susceptible to variations, modifications and changes in structure and materials of fabrication, all of which are within the skill of one familiar with the prior art following a reading of the specification and claims hereof and viewing of the drawing figures. It should be understood that all such variations, modifications and changes are within, and are not departures from, the spirit and scope of the invention and appended claims.

What I claim is:

1. In a mattress-like pad for body support, comfort and recreational use on dry land, in land vehicles, and in water craft, a light-weight, air-buoyancy improvement of said pads comprising:

a) an inner pad structure fabricated on a stacked arrangement of two or more like rectangularly sized and configured layers of two-ply laminated sheet plastic material encapsulating between the plys of each layer a multiplicity of uniformly arranged and separated air bubbles, the plys of said layers being sealed together in the areas between said air bubbles, said stacked arrangement of said like layers being maintained by inter-layer fastening means proximate each corner thereof; and b) an outer bag-like containment cover having a closed foot end and a sealably open head end and of sufficient width and length for removably encasing said inner pad structure, said cover being fabricated from an elongated strip of polyvinylchloride-coated polyester woven open mesh fabric material including a first end portion of said material folded back over a central underside portion of said material with the mating edges of said portions sealed together whereby upon inside-out reversal of said edge-sealed portions said bag-like cover is formed with the sealed edges thereof positioned within said cover, and a second end portion of said cover material extending from said central portion at the head end of said cover and forming a closure flap, the central underside portion of said cover material and said closure flap bearing mating fastener means whereby upon rolling-up of said mattress-like pad upon itself from the foot end to the head end of said cover and over said flap said mating fastener means interact to maintain said pad in its rolled-up configuration.

2. The improved mattress-like pad for body support, comfort and recreational use as claimed in claim 1 wherein the open head end of the outer bag-like containment cover is sealable by mating strips of hook and eye fastening material mounted to the inner surfaces of said first end portion and said central underside portion of said cover material proximate the open head end of said cover.

3. The improved mattress-like pad for body support, comfort and recreational use as claimed in claim 1 wherein the mating fastener means of the central underside portion of said cover material and said closure flap comprise mating strips of hook and eye fastening material mounted to said underside portion of said cover material and said closure flap.

4. The improved mattress-like pad for body support, comfort and recreational use as claimed in claim 1 wherein the sheet plastic plys of said two-ply laminated material comprising each of the stacked layers of said inner pad structure are formed of polyethylene plastic sheet material.

5. The improved mattress-like pad for body support, comfort and recreational use as claimed in claim 1 wherein the fastening means proximate each corner of the stacked arrangement of like layers of two-ply laminated sheet plastic material encapsulating separated air bubbles comprises grommets extending through said layers.

6. The improved mattress-like pad for body support, comfort and recreational use as claimed in claim 1 wherein the inner pad structure of said mattress-like pad includes five layers of said two-ply laminated sheet plastic material encapsulating separated air bubbles with each of said layers having 400 or more air bubbles per square foot of said material.

7. In a mattress-like pad for human body support, comfort and recreational use in outdoor camping, in recreational vehicles, and in water craft, a rugged construction, light-weight, and air-buoyancy improvement thereof comprising:

a) an inner pad structure fabricated of a stacked arrangement of a multiplicity of like rectangularly configured layers of two-ply laminated sheet plastic material encapsulating between the plys of each layer a multiplicity of uniformly arranged and separated air bubbles, the plys of said layers being sealed together in the areas between said air bubbles, said like layers being maintained in said stacked arrangement by inter-layer fastening means proximate each corner thereof with said like layers being otherwise free to shift with respect to one-another to accommodate human body support characteristics and permit tight rolling-up of said mattress-like pads for the storage of carrying thereof; and b) an outer bag-like containment cover for said inner pad structure, said cover having a closed foot end and a sealably open head end and being of sufficient width and length for removably encasing said inner pad structure, said cover being fabricated from an elongated strip of polyvinylchloride-coated polyester woven open mesh fabric material and including a first end portion of said material folded back over a central underside portion of said material with the mating side edges of said first portion and of said central portion sealed together whereby upon inside-out reversal of said edge-sealed portions said bag-like cover is formed with the sealed edges thereof positioned within said cover, and a second end portion of said cover material extending from said central portion at the head end of said cover and forming a closure flap for said mattress-like pad, the central underside portion of said cover material and said closure flap bearing mating fastener means whereby upon rolling-up of said mattress-like pad upon itself from the foot end to the head end of said cover and over said closure flap said mating fastener means interact to maintain said mattress-like pad in its rolled-up configuration.

8. The improved mattress-like pad for human body support, comfort and recreational use as claimed in claim 7 wherein the open head end of the outer bag-like containment cover is sealable by mating strips of velcro hook and eye fastening material mounted to the inner surfaces, respectively, of said first end portion and said central underside portion of said cover material proximate the open head end of said cover.

9. The improved mattress-like pad for human body support, comfort and recreational use as claimed in claim 7 wherein the inner pad structure of said mattress-like pad includes five layers of said two-ply laminated sheet plastic material encapsulating separated air bubbles, said air bubbles having a height between the plys of said laminated sheet plastic material of from about $\frac{1}{8}$ inch to about $\frac{1}{4}$ inch, and each of said layers having at least 400 air bubbles per square foot of said material.

10. The improved mattress-like pad for human body support, comfort and recreational use as claimed in claim 7 wherein the fastening means proximate each corner of the stacked arrangement of like layers of two-ply laminated sheet plastic material encapsulating separated air bubbles comprises grommet-type fasteners extending through said layers.

* * * * *